US008955904B1

(12) United States Patent
Zhu

(10) Patent No.: US 8,955,904 B1
(45) Date of Patent: Feb. 17, 2015

(54) MOON CHAIR STRUCTURE

(71) Applicant: Xiaohui Zhu, Zhejiang Province (CN)

(72) Inventor: Xiaohui Zhu, Zhejiang Province (CN)

( * ) Notice: Subject to any disclaimer, the term of this patent is extended or adjusted under 35 U.S.C. 154(b) by 0 days.

(21) Appl. No.: 14/108,300

(22) Filed: Dec. 16, 2013

(30) Foreign Application Priority Data

Sep. 24, 2013 (CN) ..... 2013 2 0589773 U

(51) Int. Cl.
*A47C 4/28* (2006.01)
*A47C 4/00* (2006.01)
*A47C 4/48* (2006.01)

(52) U.S. Cl.
CPC ... *A47C 4/28* (2013.01); *A47C 4/00* (2013.01); *A47C 4/48* (2013.01)
USPC ..... 297/16.1; 297/46; 297/452.13

(58) Field of Classification Search
USPC ..... 297/16.1, 46–48, 452.13
See application file for complete search history.

(56) References Cited

U.S. PATENT DOCUMENTS

| | | | | |
|---|---|---|---|---|
| 2,733,755 | A * | 2/1956 | Boucher | 297/411.41 |
| 6,332,646 | B1 * | 12/2001 | Tseng | 297/16.1 |
| 6,848,740 | B1 * | 2/2005 | Reese | 297/16.1 |
| 6,971,712 | B1 * | 12/2005 | Tseng | 297/32 |
| 7,000,983 | B1 * | 2/2006 | Tsai | 297/56 |
| 7,144,078 | B2 * | 12/2006 | Hsieh | 297/16.1 |
| 7,967,374 | B2 * | 6/2011 | Akkad | 297/42 |
| 2004/0245810 | A1 * | 12/2004 | Tseng | 297/56 |
| 2005/0088018 | A1 * | 4/2005 | Yao | 297/16.1 |

* cited by examiner

*Primary Examiner* — Peter Brown

(57) ABSTRACT

A moon chair structure comprising a seat ring tube, a front leg tube, a rear leg tube and back supporting rods; the front leg tube, the rear leg tube and the back supporting rods form a frame for supporting the seat ring tube; the rear leg tube and the front leg tube intersect with each other to form a supporting leg; slidable sleeves are provided at top ends of the rear leg tube; the slidable sleeves sleeve on the back supporting rods for forward and backward sliding movement on the back supporting rods; the slidable sleeves disposed at the top ends of the rear leg tube are slidable with respective to the back supporting rods; dynamic and variable triangular structures are formed by coordination between the rear leg tube, the front leg tube and the back supporting rods.

5 Claims, 5 Drawing Sheets

MOON CHAIR STRUCTURE

BACKGROUND OF THE INVENTION

The present invention discloses a kind of moon chair structure and it should belong to the field of art relating to moon chair according to the International Patent Classification (IPC). The present invention specifically relates to a kind of foldable moon chair.

Nowadays, a round foldable chair is made by soft surface material and a supporting frame. The seat cushion of this kind of round foldable chair is circular in shape when it is viewed at the front, but it looks like a crescent moon when it is viewed at the sides. Accordingly, this kind of round foldable chair is called a moon chair. A moon chair has a simple structure and an interesting design.

A moon chair structure is disclosed in Chinese patent application number 201220073389.9, in which the moon chair comprises a front supporting legs set, a rear supporting legs set, a back supporting rod disposed on the rear supporting legs set, and a support rack connecting to the front supporting legs set and the back supporting rod, wherein the support rack is discontinued at the front supporting legs set and thus forming a "C" shape, and the supporting legs sets being used are complicated. Chinese patent application number 200920137393.5 discloses another moon chair structure comprising a circular seat ring, a front U shape leg, a rear U shape leg, and a slidable sleeve is hinged at each of the two rod pieces of the front U shape leg; two corresponding rod pieces of the rear U shape leg is inserted into the corresponding slidable sleeves to form a movable hinge structure between the front U shape leg and the rear U shape leg; also, a connecting rod is securely riveted at each of the two sides of the seat ring; an upper end of a respective rod piece of the front U shape leg and an upper end of a respective rod piece of the rear U shape leg are hinged correspondingly to a respective connecting rod; the front U shape leg and the rear U shape leg are movably connected; the rear U shape leg can slide along the front U shape leg; sliders are mounted on the rear U shape leg; connecting plates are also mounted between the rear U shape leg and the front U shape leg; therefore, Chinese patent application number 200920137393.5 has a complicated structure and poor stability.

After a long period of research taken into account the specific features of a moon chair, the inventor has invented a novel frame structure for moon chair, as will be described in the present invention.

BRIEF SUMMARY OF THE INVENTION

In view of the aforesaid disadvantages now present in the prior art, the present invention provides a kind of moon chair structure which is safe and reliable, and allows convenient storage.

To attain the above purposes, the present invention adopts the following technical proposal:

A moon chair structure comprising a seat ring tube, a front leg tube, a rear leg tube and back supporting rods, wherein:

the seat ring tube is a circular tube for position fixing of surface material attached to the seat;

the front leg tube, the rear leg tube and the back supporting rods form a frame for supporting the seat ring tube; when the frame is unfolded, the seat ring tube is disposed in an inclined position;

the back supporting rods comprise a left supporting rod and a right supporting rod which are disposed on two sides of the seat ring tube respectively and which extend through a space confined by the seat ring tube;

the rear leg tube and the front leg tube intersect with each other to form a supporting leg; slidable sleeves are provided at top ends of the rear leg tube; the slidable sleeves sleeve on the back supporting rods for forward and backward sliding movement on the back supporting rods; each supporting rod of the back supporting rods together with a corresponding upper section of the rear leg tube and a corresponding upper section of the front leg tube arranged on the same side form a dynamic and variable triangular structure;

further, the front leg tube and the rear leg tube are both in U shape each having a left branch rod and a right branch rod; the left branch rod of the front leg tube and the left branch rod of the rear leg tube intersect longitudinally with each other and are hinged with each other; the right branch rod of the front leg tube and the right branch rod of the rear leg tube intersect longitudinally with each other and are hinged with each other; a portion between the left branch rod of the front leg tube and the left branch rod of the rear leg tube and above a point at which the left branch rod of the front leg tube and the left branch rod of the rear leg tube are hinged is a variable triangular structure; a portion between the right branch rod of the front leg tube and the right branch rod of the rear leg tube and above a point at which the right branch rod of the front leg tube and the right branch rod of the rear leg tube are hinged is also a variable triangular structure;

further, a front end and a rear end of each supporting rod of the back supporting rods are provided with blocking sleeves respectively;

further, top ends of the front leg tube are hinged with the back supporting rods; cushion tubes are provided at the point at which the left branch rod of the front leg tube and the left branch rod of the rear leg tube are intersected and hinged and at the point at which the right branch rod of the front leg tube and the right branch rod of the rear leg tube are intersected and hinged respectively; hinge axles are provided, one of which passes through the left branch rod of the front leg tube, the left branch rod of the rear leg tube and a respective cushion tube of the cushion tubes provided at the point at which the left branch rod of the front leg tube and the left branch rod of the rear leg tube are intersected and hinged, and another one of which passes through the right branch rod of the front leg tube, the right branch rod of the rear leg tube and a respective cushion tube of the cushion tubes provided at the point at which the right branch rod of the front leg tube and the right branch rod of the rear leg tube are intersected and hinged;

further, the top ends of the rear leg tube are connected to the slidable sleeves through rear leg head sleeves; the slidable sleeves sleeve on the back supporting rods; the front end of each supporting rod of the back supporting rods 4 is provided with a front blocking sleeve of the blocking sleeves; the front blocking sleeve of each supporting rod of the back supporting rods is fixed with an arc shaped supporting plate provided with an arc shaped groove; the arc shaped groove of the arc shaped supporting plate fixed with each supporting rod of the back supporting rods has the seat ring tube positioned therein and connected fixedly thereto.

In the present invention, the slidable sleeves disposed at the top ends of the rear leg tube are slidable with respective to the back supporting rods; dynamic and variable triangular structures are formed by coordination between the rear leg tube, the front leg tube and the back supporting rods. The present invention is structurally reasonable and easy to fold. When the present invention is unfolded, the seat ring tube is higher at the back and lower at the front, and it is supported by the back supporting rods arranged in a parallel manner at two sides of the seat ring tube. Accordingly, users can seat safely and comfortably on the seat of the moon chair.

DETAILED DESCRIPTION OF THE INVENTION

Figure 1:
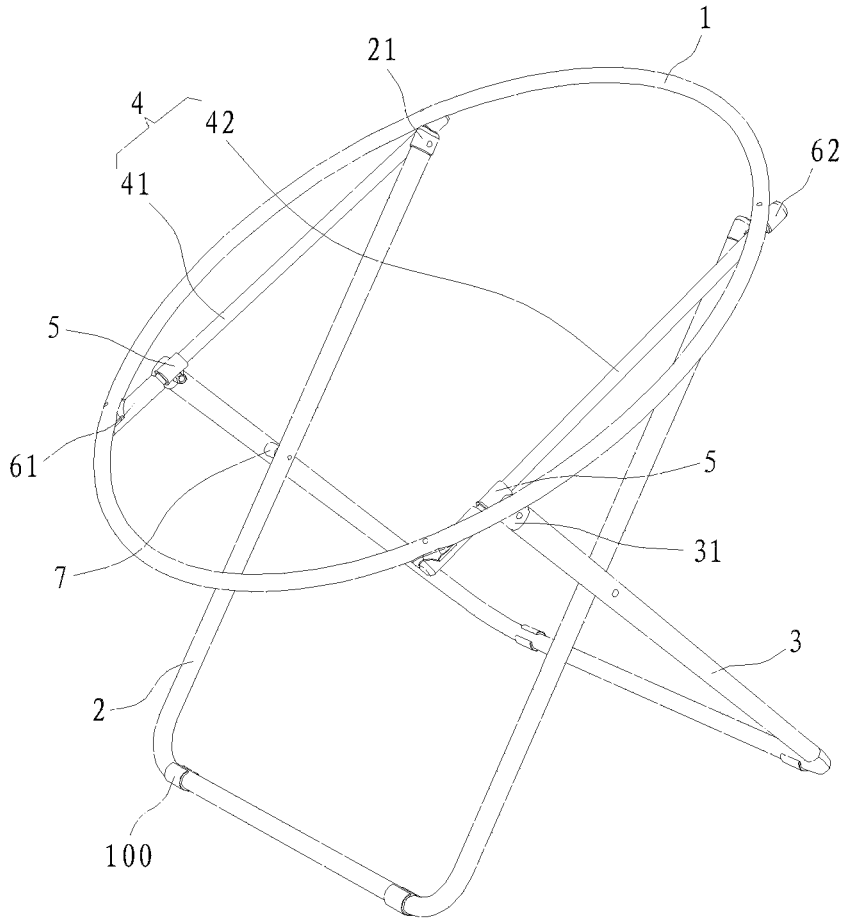
FIG. 1 shows an unfolded state of the present invention.

The present invention is further described below with reference to the accompanying drawings.

Embodiment: as illustrated in FIGS. 1 to 7, a moon chair structure comprises a seat ring tube 1, a front leg tube 2, a rear leg tube 3 and back supporting rods 4, wherein:

The seat ring tube 1 is a circular tube for position fixing of surface material attached to the seat.

The front leg tube 2, the rear leg tube 3 and the back supporting rods 4 form a frame for supporting the seat ring tube 1; when the frame is unfolded, the seat ring tube 1 is disposed in an inclined position.

The back supporting rods 4 comprise a left supporting rod 41 and a right supporting rod 42 which are disposed in a parallel manner on two sides of the seat ring tube 1 respectively and which extend through a space confined by the seat ring tube 1.

The rear leg tube 3 and the front leg tube 2 intersect with each other to form a supporting leg; slidable sleeves 5 are provided at top ends of the rear leg tube 3; the slidable sleeves 5 sleeve on the back supporting rods 4 for forward and backward sliding movement on the back supporting rods 4; each supporting rod (the left supporting rod 41 or the right supporting rod 42) of the back supporting rods 4 together with a corresponding upper section of the rear leg tube 3 and a corresponding upper section of the front leg tube 2 arranged on the same side form a dynamic and variable triangular structure; a front end and a rear end of each supporting rod of the back supporting rods 4 are provided with a front blocking sleeve 61 and a rear blocking sleeve 62 respectively; as shown in FIG. 1, the front blocking sleeve 61 of each of the back supporting rods 4 also acts as a position limiting means to limit forward sliding of a respective slidable sleeve of the slidable sleeves 5 sleeved at a respective supporting rod of the back supporting rods 4.

Figure 3:
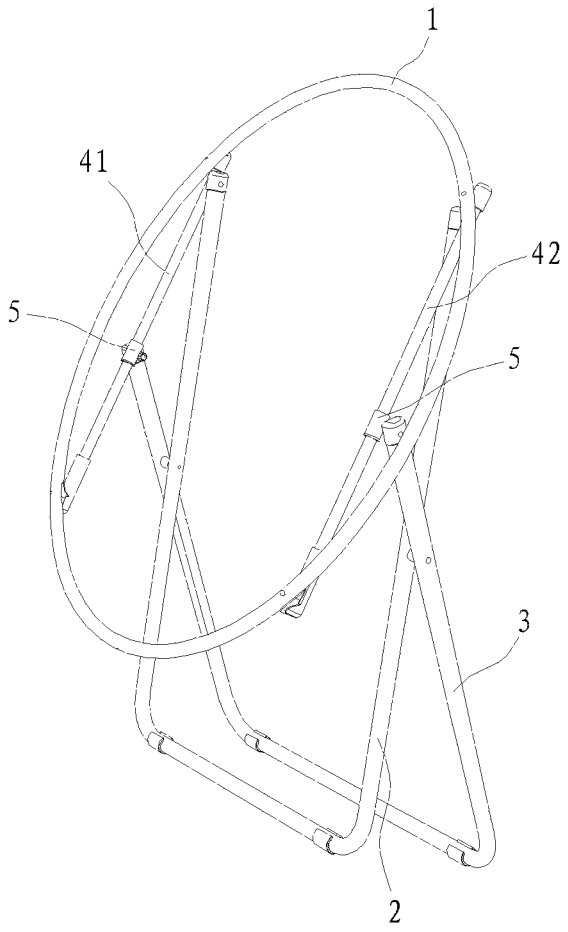
FIG. 3 is a second view illustrating the present invention in a folding state.
Figure 4:
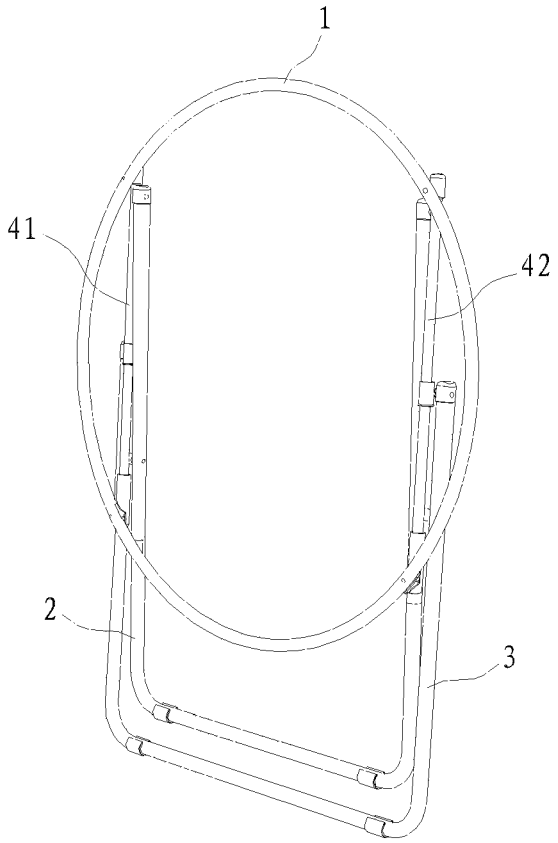
FIG. 4 is a third view illustrating the present invention in a folding state.
Figure 5:
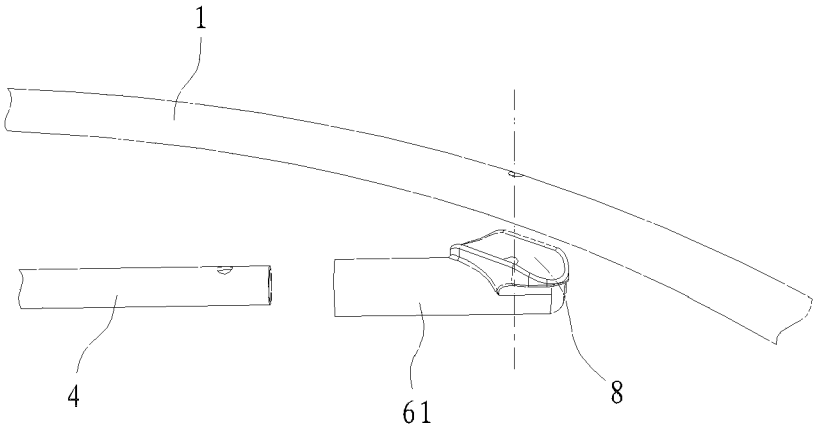
FIG. 5 shows the seat ring tube and one of the back supporting rods of the present invention ready to be assembled.
Figure 6:
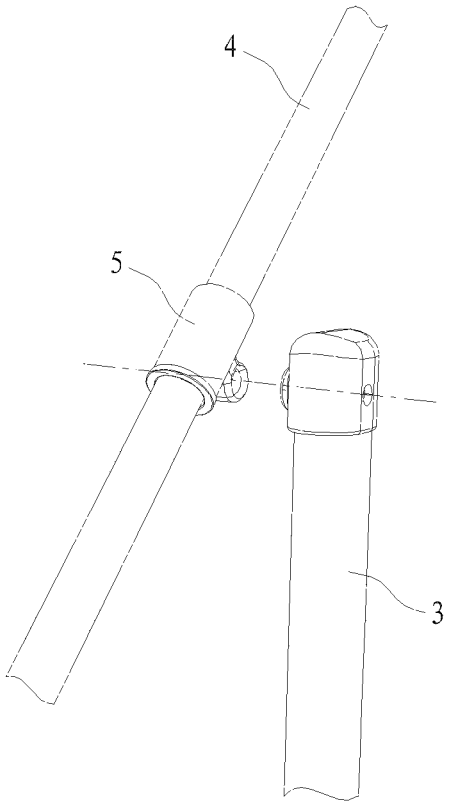
FIG. 6 shows the rear leg tube and one of the back supporting rods of the present invention ready to be assembled.
Figure 7:
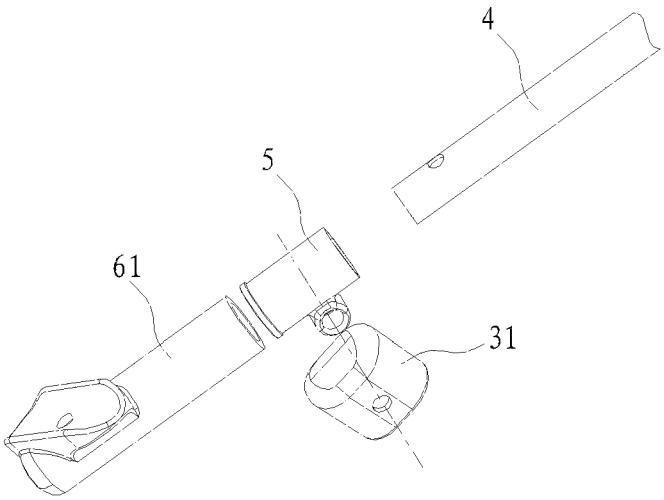
FIG. 7 shows one of the slidable sleeves of the back supporting rods and one of the rear leg head sleeves of the present invention ready to be assembled.

As shown in FIG. 1, 3 or 4, the front leg tube 2 and the rear leg tube 3 are both in U shape each having a left branch rod, a right branch rod and a base rod. The left branch rod of the front leg tube 2 and the left branch rod of the rear leg tube 3 intersect longitudinally with each other and are hinged with each other; the right branch rod of the front leg tube 2 and the right branch rod of the rear leg tube 3 intersect longitudinally with each other and are hinged with each other; a portion between the left branch rod of the front leg tube 2 and the left branch rod of the rear leg tube 3 and above a point at which the left branch rod of the front leg tube 2 and the left branch rod of the rear leg tube 3 are hinged is a variable triangular structure; a portion between the right branch rod of the front leg tube 2 and the right branch rod of the rear leg tube 3 and above a point at which the right branch rod of the front leg tube 2 and the right branch rod of the rear leg tube 3 are hinged is also a variable triangular structure. Base rod of the front leg tube 2 and base rod of the rear leg tube 3 are both provided with base sleeves 100. Front leg head sleeves 21 are provided at top ends of the front leg tube 2 and the front leg head sleeves 21 are hinged with the back supporting rods 4. Cushion tubes 7 are provided at the point at which the left branch rod of the front leg tube 2 and the left branch rod of the rear leg tube 3 are hinged and at the point at which the right branch rod of the front leg tube 2 and the right branch rod of the rear leg tube 3 are hinged respectively. Hinge axles are provided, one of which passes through the left branch rod of the front leg tube 2, the left branch rod of the rear leg tube 3 and a respective cushion tube of the cushion tubes 7 provided at the point at which the left branch rod of the front leg tube 2 and the left branch rod of the rear leg tube 3 are hinged, and another one of which passes through the right branch rod of the front leg tube 2, the right branch rod of the rear leg tube 3 and a respective cushion tube of the cushion tubes 7 provided at the point at which the right branch rod of the front leg tube 2 and the right branch rod of the rear leg tube 3 are hinged. As shown in FIG. 5 to FIG. 7, the top ends of the rear leg tube 3 are connected to the slidable sleeves 5 through rear leg head sleeves 31. The slidable sleeves 5 sleeve on the back supporting rods 4; the front end of each supporting rod of the back supporting rods 4 is provided with the front blocking sleeve 61; the front blocking sleeve 61 of each supporting rod of the back supporting rods 4 is fixed with an arc shaped supporting plate 8 provided with an arc shaped groove; the arc shaped groove of the arc shaped supporting plate 8 fixed with each supporting rod of the back supporting rods 4 has the seat ring tube 1 positioned therein and connected fixedly thereto.

Figure 2:
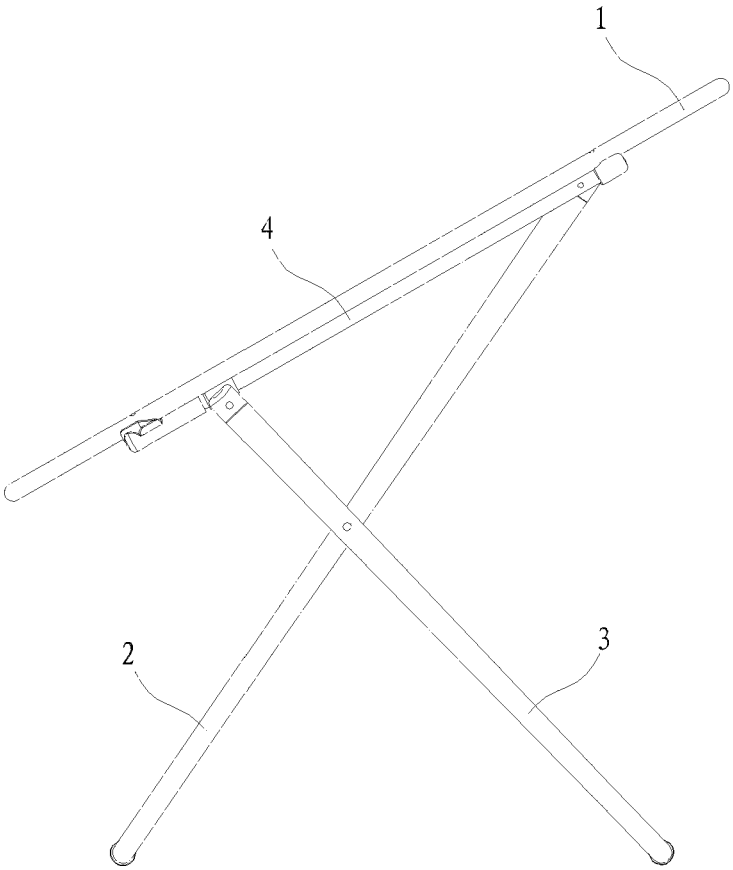
FIG. 2 is a first view illustrating the present invention in a folding state.

In the present invention, the slidable sleeves 5 disposed at the top ends of the rear leg tube 3 are slidable with respective to the back supporting rods 4; dynamic and variable triangular structures are formed by coordination between the rear leg tube 3, the front leg tube 2 and the back supporting rods 4. FIG. 2 to FIG. 4 illustrate the folding up of the moon chair. The present invention is structurally reasonable and easy to fold. When the present invention is unfolded, the seat ring tube 1 is higher at the back and lower at the front, and it is supported by the back supporting rods 4 arranged in a parallel manner at two sides of the seat ring tube 1. Accordingly, the present invention uses a more user-oriented design so that users can seat safely and comfortably on the seat of the moon chair.

The above description is only an embodiment of the present invention. The scope of protection of the present invention is not limited to the embodiment described above. Any modification and changes without deviating from the scope of the present invention can be made by any person skilled in this field of art should fall within the scope of protection of the present invention.

What is claimed is:

1. A moon chair structure comprising a seat ring tube, a front leg tube, a rear leg tube and back supporting rods, wherein:

the seat ring tube is a circular tube for position fixing of surface material attached to the seat;

the front leg tube, the rear leg tube and the back supporting rods form a frame for supporting the seat ring tube; when the frame is unfolded, the seat ring tube is disposed in an inclined position;

the back supporting rods comprise a left supporting rod and a right supporting rod which are disposed on two sides of the seat ring tube respectively and which extend through a space confined by the seat ring tube;

the rear leg tube and the front leg tube intersect with each other to form a supporting leg; slidable sleeves are provided at top ends of the rear leg tube; the slidable sleeves sleeve on the back supporting rods for forward and backward sliding movement on the back supporting rods; each supporting rod of the back supporting rods together with a corresponding upper section of the rear leg tube and a corresponding upper section of the front leg tube arranged on the same side form a dynamic and variable triangular structure.

2. The moon chair structure as in claim 1, wherein the front leg tube and the rear leg tube are both in U shape each having a left branch rod and a right branch rod; the left branch rod of the front leg tube and the left branch rod of the rear leg tube intersect longitudinally with each other and are hinged with each other; the right branch rod of the front leg tube and the right branch rod of the rear leg tube intersect longitudinally with each other and are hinged with each other; a portion between the left branch rod of the front leg tube and the left branch rod of the rear leg tube and above a point at which the left branch rod of the front leg tube and the left branch rod of the rear leg tube are hinged is a variable triangular structure; a portion between the right branch rod of the front leg tube and the right branch rod of the rear leg tube and above a point at which the right branch rod of the front leg tube and the right branch rod of the rear leg tube are hinged is also a variable triangular structure.

3. The moon chair structure as in claim 2, wherein top ends of the front leg tube are hinged with the back supporting rods; cushion tubes are provided at the point at which the left branch rod of the front leg tube and the left branch rod of the rear leg tube are intersected and hinged and at the point at which the right branch rod of the front leg tube and the right branch rod of the rear leg tube are intersected and hinged respectively; hinge axles are provided, one of which passes through the left branch rod of the front leg tube, the left branch rod of the rear leg tube and a respective cushion tube of the cushion tubes provided at the point at which the left branch rod of the front leg tube and the left branch rod of the rear leg tube are intersected and hinged, and another one of which passes through the right branch rod of the front leg tube, the right branch rod of the rear leg tube and a respective cushion tube of the cushion tubes provided at the point at which the right branch rod of the front leg tube and the right branch rod of the rear leg tube are intersected and hinged.

4. The moon chair structure as in claim 1, wherein a front end and a rear end of each supporting rod of the back supporting rods are provided with blocking sleeves respectively.

5. The moon structure as in claim 4, wherein the top ends of the rear leg tube are connected to the slidable sleeves through rear leg head sleeves; the slidable sleeves sleeve on the back supporting rods; the front end of each supporting rod of the back supporting rods 4 is provided with a front blocking sleeve of the blocking sleeves; the front blocking sleeve of each supporting rod of the back supporting rods is fixed with an arc shaped supporting plate provided with an arc shaped groove; the arc shaped groove of the arc shaped supporting plate fixed with each supporting rod of the back supporting rods has the seat ring tube positioned therein and connected fixedly thereto.

* * * * *